US006512492B2

(12) United States Patent
Overton

(10) Patent No.: US 6,512,492 B2
(45) Date of Patent: Jan. 28, 2003

(54) ANTENNA QUICK CONNECT SYSTEM AND METHOD

(75) Inventor: Steven R. Overton, Seattle, WA (US)

(73) Assignee: Harris Broadband Wireless Access, Inc., Bellevue, WA (US)

( * ) Notice: Subject to any disclaimer, the term of this patent is extended or adjusted under 35 U.S.C. 154(b) by 0 days.

(21) Appl. No.: 09/893,007

(22) Filed: Jun. 28, 2001

(65) Prior Publication Data

US 2002/0105476 A1 Aug. 8, 2002

Related U.S. Application Data

(60) Provisional application No. 60/266,458, filed on Feb. 6, 2001.

(51) Int. Cl.[7] ..... H01Q 1/12

(52) U.S. Cl. ..... 343/891; 343/892; 343/882

(58) Field of Search ..... 343/839, 840, 343/882, 890, 981, 982, 912

(56) References Cited

U.S. PATENT DOCUMENTS

| | | | | | |
|---|---|---|---|---|---|
| 4,489,329 | A | * | 12/1984 | Vezain et al. | 24/506 |
| 4,626,864 | A | * | 12/1986 | Micklethwaite | 248/183.2 |
| 5,815,895 | A | * | 10/1998 | Carlson et al. | 24/603 |
| 5,988,583 | A | * | 11/1999 | Rhine | 248/523 |
| 6,262,691 | B1 | * | 7/2001 | Austin et al. | 343/878 |
| 6,342,870 | B1 | * | 1/2002 | Mehrkens et al. | 343/890 |
| 6,361,007 | B1 | * | 3/2002 | Oby et al. | 248/285.1 |
| 6,452,567 | B1 | * | 9/2002 | Overton | 343/882 |

* cited by examiner

*Primary Examiner*—Don Wong
*Assistant Examiner*—Shih-Chao Chen
(74) *Attorney, Agent, or Firm*—Duane Morris LLP

(57) ABSTRACT

This application is directed to a spring loaded antenna mounting system for the directional antennae of a point-to-multipoint millimeter wave communications system and methods of supporting such antennae for selectively directing the beam thereof. Also disclosed is the adjustment of such antennae in two orthogonal directions. In addition quick connect/disconnect latch for attaching the individual antenna element to the antennae mount is disclosed.

8 Claims, 9 Drawing Sheets

ANTENNA QUICK CONNECT SYSTEM AND METHOD

The present application claims the priority of pending U.S. Provisional Application Ser. No. 60/266,485 filed Feb. 6, 2001 for "Antenna Provisional," the disclosure of which is hereby incorporated herein by reference. This application is related to and is being concurrently filed with commonly assigned U.S. patent application Ser. No. 09/893,010, entitled Spring Loaded Antenna Mounting System and Method now U.S. Pat. No. 6,456,258 and Ser. No. 09/893,013, entitled Geared Antenna Aiming System and Method, the disclosures of which are hereby incorporated herein by reference. The present invention relates generally to antennae mounting systems and methods for wireless communication systems, and more specifically to antennae mounting systems and methods for millimeter wave point-to-multipoint communication systems.

BACKGROUND

Point-to-multipoint millimeter wave wireless communication systems are well know and are described, e.g., in the commonly assigned U.S. Pat. No. 6,016,313, entitled "System and Method for Broadband Millimeter Wave Data Communication." Such systems generally consist of one or more hubs each servicing a plurality of remote nodes. The antennae of such systems are highly directional and it is critical to the successful operation of the communication system that each antennae be correctly aimed in both azimuth and elevation. It is accordingly an object of the present invention to provide a novel antennae mounting system which may be selectively aimed in both azimuth and elevation.

Point-to-multipoint communication systems are generally modular with reconfiguration of the coverage of the antennae required, e.g., as the number of subscribers increases within a sector, as subscribers come on line in sectors previously not serviced, as the communication traffic increases within a sector, etc. It is therefore another object of the present invention to provide a novel antennae mounting system and method in which antennae be easily added or moved to effect reconfiguration of the antennae system to accommodate the dynamic changes in the communication system.

Antennae in such systems are often mounted on preexisting structures and there are often physical limitations placed on the construction of new antenna support structures. It is accordingly a further object of the present invention to provide a novel antennae mounting system and method in which the antennae which may be easily and quickly installed on a variety of support structures.

Further, there are difficulties in the installation and aiming of directional antennae, where space is confined and a single installer may be faced with the simultaneous positioning and installation of an antenna at a significant elevation exposed to adverse wind conditions. It is accordingly yet another object of the present invention to provide a novel antennae mounting system and method in which the antennae may be quickly removed or quickly installed and thereafter selectively secured and aimed.

These and other objects and advantages will be readily apparent from the following detailed description of illustrative embodiments when read in conjunction with the appended drawings.

DETAILED DESCRIPTION

Figure 1:
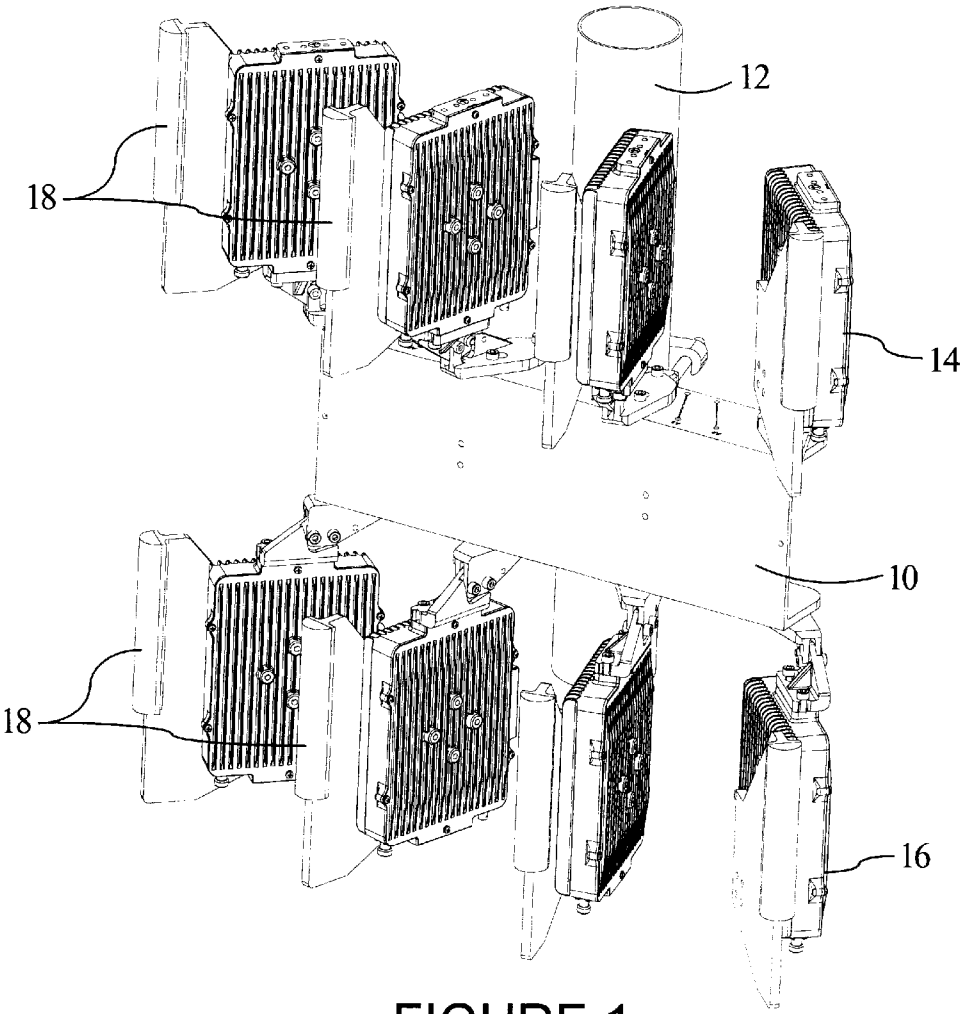
FIGURE 1 (PRIOR ART)
FIG. 1 is a pictorial view of a typical point-to-multipoint hub antenna.

FIG. 1 illustrates a typical hub mounting for plural antennae in a millimeter wave point-to-multipoint wireless communication system. In the embodiment shown, there is a mounting plate 10 secured in a conventional manner to a tubular support 12. Two rows of antennae are illustrated, with the top row 14 having a different degree of elevation than the bottom row 16 to service relatively far and near subscribers respectively. Within each row, each highly directional antennae 18 is offset in azimuth by fifteen degrees to service an area approximately sixty degrees wide.

Figure 2:
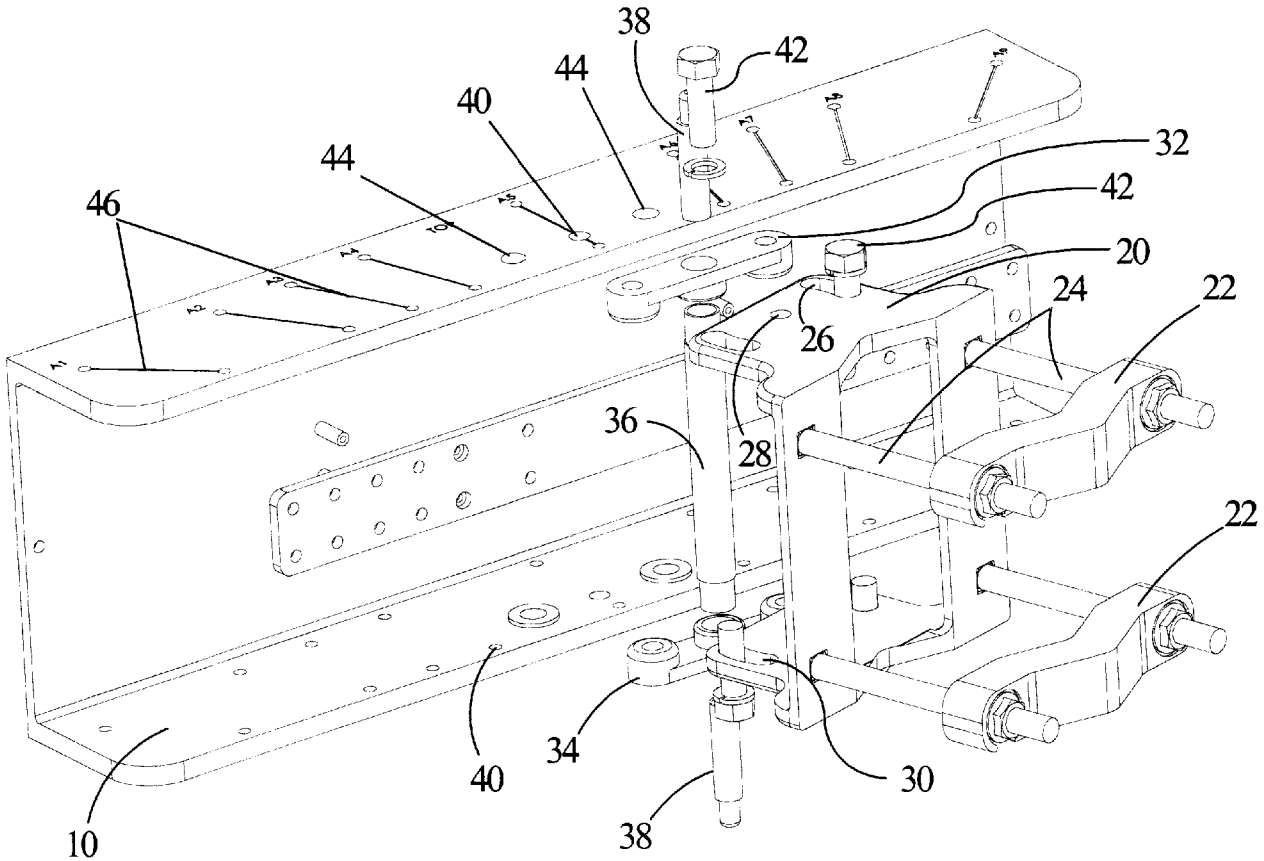
FIG. 2 is an exploded view of one embodiment of the spring loaded antenna mount of the present invention.

As shown in FIG. 2, the mounting plate 10 may be mounted on the pole 12 (not shown) by means of a mounting bracket 20 notched to receive the pole and having two notched backing members 22 secured thereto by way of four bolts 24. The upper and lower flanges 26 of the pole bracket 20 desirably include a central opening 28 and two generally arcuate slots 30 into which are received three protrusions of a top and bottom plate 32,34. Disposed between the flanges 26 is a spring biased pin comprising a central tube 36 which houses a coil spring (not shown) held under relatively slight compression by two end protrusions 38. The protrusions 38 are restrained by any suitable conventional means from completely exiting the tube 36. The pole bracket is relatively easy to install because of its small size and light weight.

With continued reference to FIG. 2, the mounting plate 10 may then be secured to the mounting bracket 20 without the necessity for precise alignment. One of he pins 38 may be depressed into the tube 36 against the pressure of the spring sufficiently to permit the flange of the mounting bracket to slide over the plates 32,34 to align the holes 40 therewith, at which point the pins 38 extend through the holes 40 under the bias of the spring within the tube 36. At this point, the bracket 10 is secured to the mounting bracket 20 and the installer no longer has to deal with the weight of the mounting bracket.

With the pins 38 extended, the bolts 42 may be positioned in the holes 44 in the mounting bracket, through the holes in the plates 32 and the arcuate slots 30. The mounting bracket 10 may then be turned in azimuth relative to the pole bracket 20 and tightened to fix the position thereof relative to the slots 30. Minor adjustments in azimuth may thus be made in the orientation of the mounting bracket 10 without the need for adjusting the mounting of the pole bracket 20 to the pole 12.

As shown in FIG. 2, the flanges of the mounting bracket may be provided with pre-punched holes and lines 46 indicating the alignment of antenna elements relative to the bracket and thus to each other. Installation of the individual antennae to the bracket 10 may thus be facilitated and the relative alignment of the antennae secured without individually aligning the antenna elements.

Note that at no point in the installation is the installer required to deal with the weight of a pre-assembled antenna nor individually adjust the antenna elements.

Figure 3:
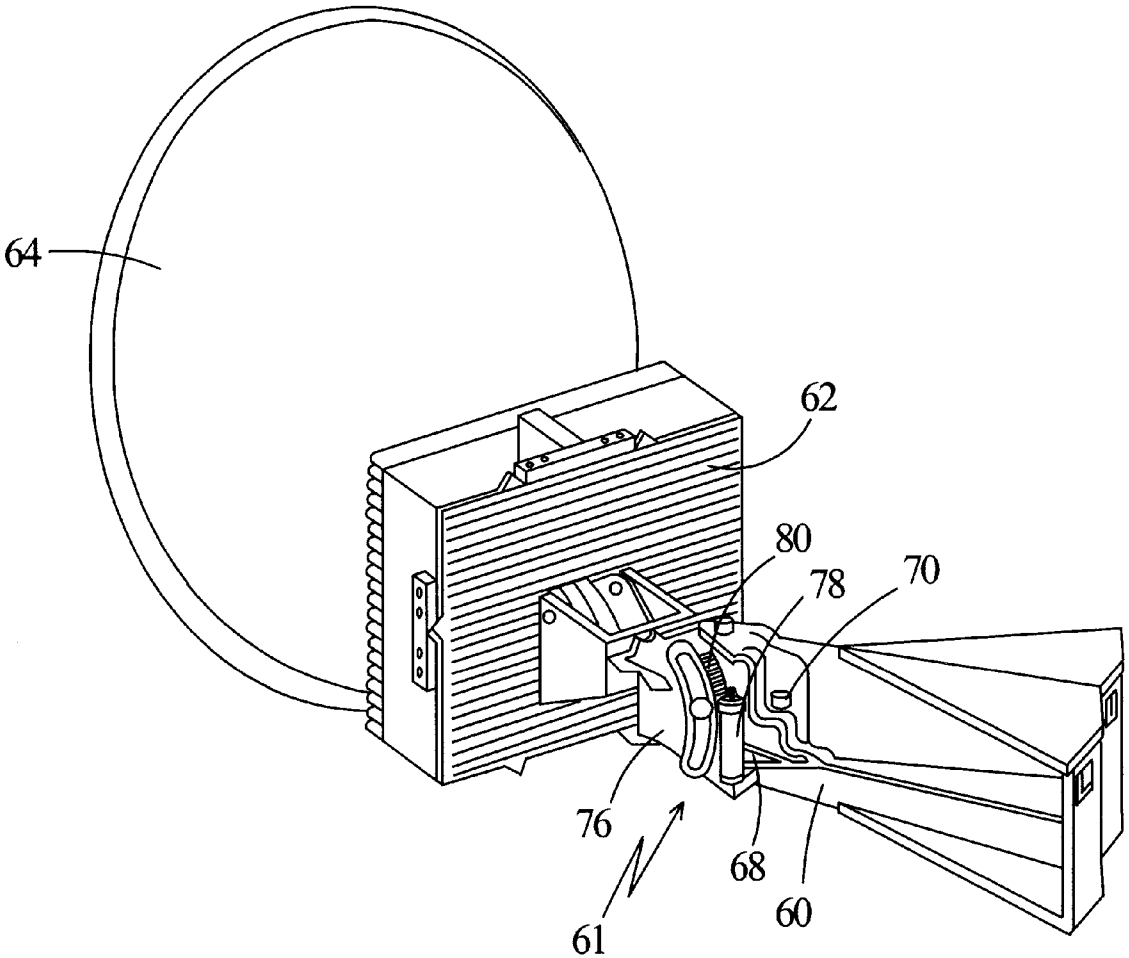
FIG. 3 is a pictorial view of an embodiment of a parabolic antenna mount of the present invention illustrating two degrees of adjustment.
Figure 4:
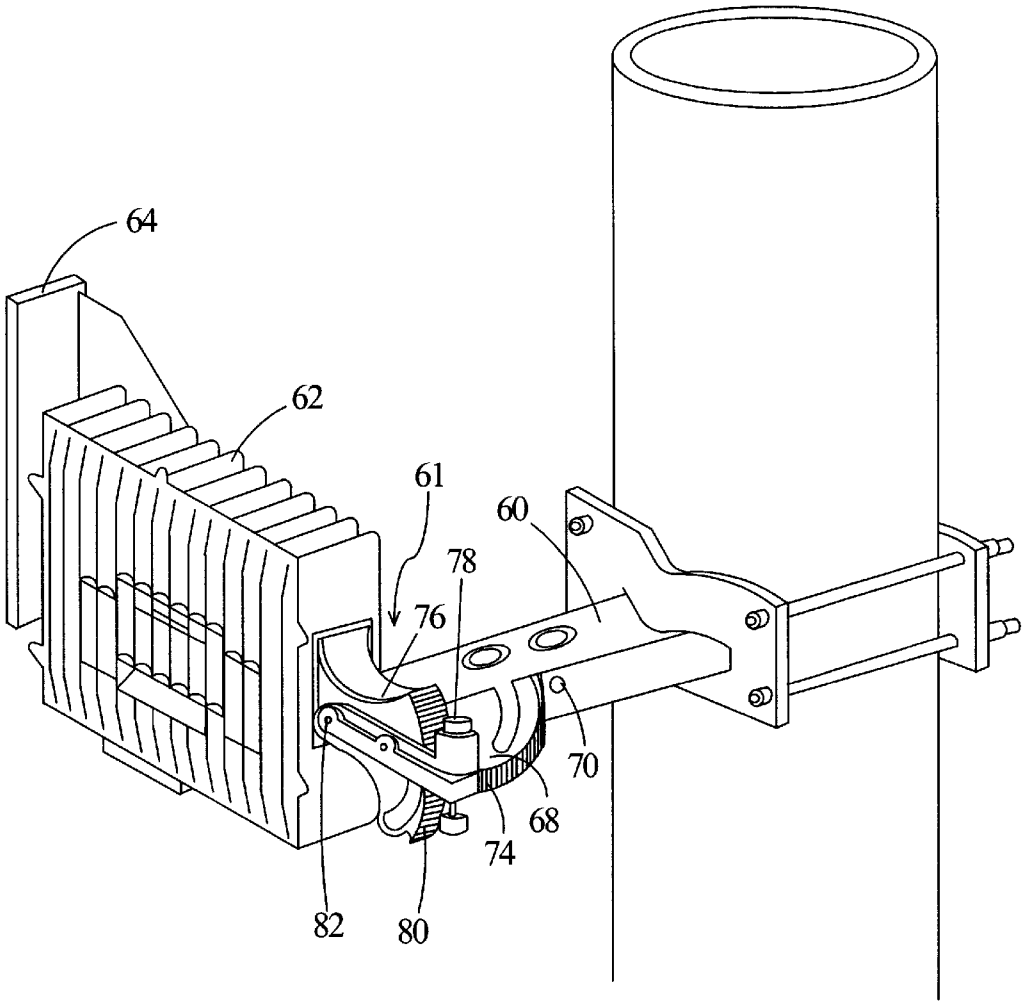
FIG. 4 is a pictorial view of an embodiment of a dipole antenna mount of the present invention illustrating two degrees of adjustment.
Figure 5:
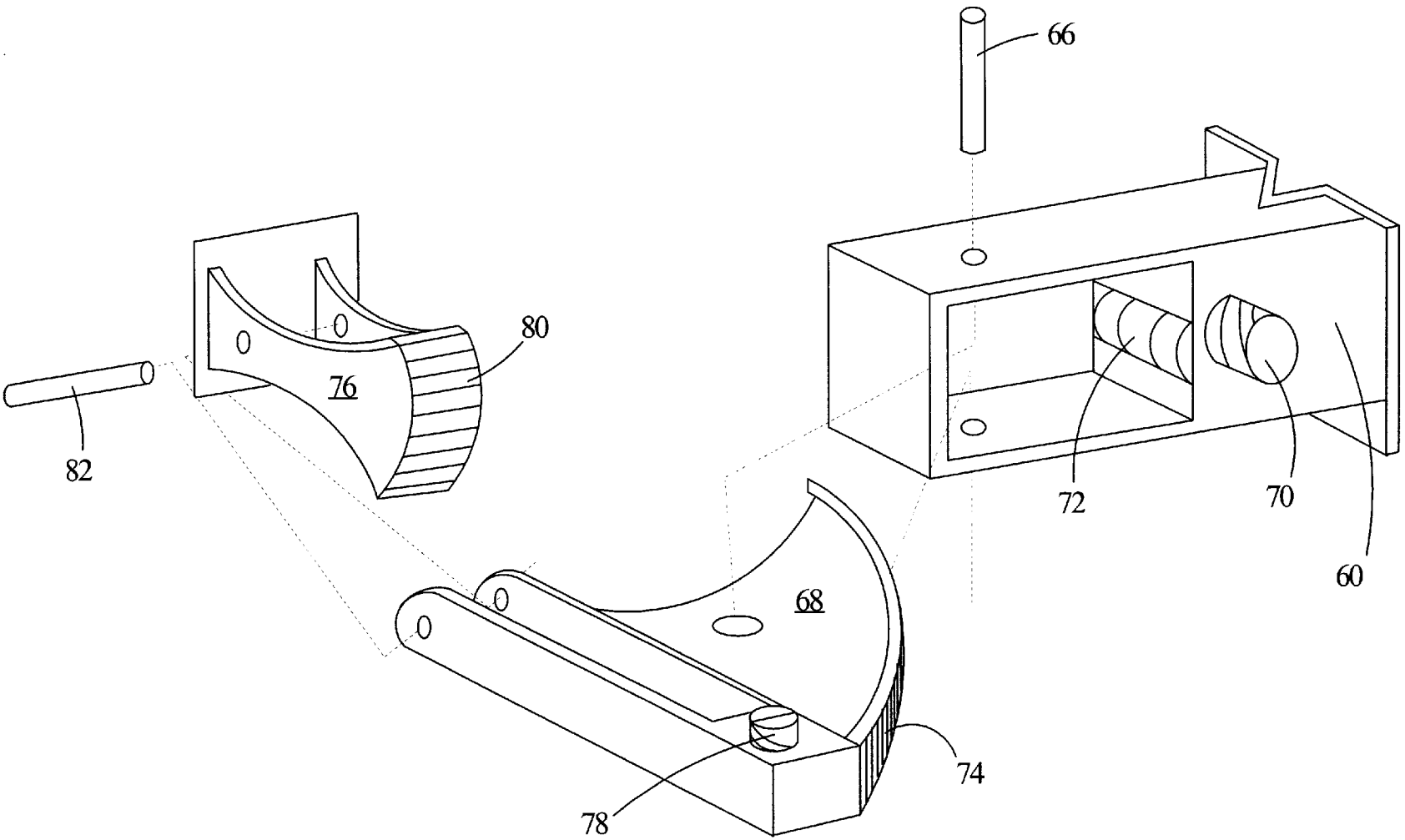
FIG. 5 is a schematic exploded view of one mechanism for achieving the two degrees of adjustment in the embodiments of FIG. 3 and FIG. 4.

In the embodiment shown in FIG. 2, adjustments in elevation must be made by the adjustment of the antenna bracket 10 to the pole 12 or the individual antennas (not shown) to the bracket 10. However, FIGS. 3–5 illustrate an antenna bracket which facilitates adjustments in both elevation and azimuth. With reference to FIGS. 3–5 where like functional elements have been given like numeric designations, the pole mounting bracket 60 may be attached to the pole or other supporting structure in any suitable conventional way such as the manner illustrated in FIG. 2. The pole mounting bracket 60 supports the antenna mount 61 in the manner to be described infra. The antenna unit 62 including the actual antenna 64 is in turn supported by antenna mount 61.

As shown in FIGS. 3 and 4 and schematically illustrated in FIG. 5, the pole bracket 60 includes a pivotal support 66 for a first adjustment member 68 the manually rotatable knob 70 of a threaded screw 72.

The first adjustable member 68 carries an arcuate threaded surface 74 which mates with the screw 72 when the first adjustable member is pivotally supported by the pin 66. In this way, the manual rotation of the knob 70 effects rotation of the first adjustable member 68 about the pin 66 to position the antenna in one orthogonal direction, azimuth or elevation as determined by the orientation of the pole mount 60.

The first adjustable member includes a pivotal support for a second adjustable member 76 and includes threaded manually operable knob 78 for a screw which engages a threaded arcuate surface 80 on the second adjustment member 76. In this way, rotation of the knob 78 effects rotation of the second adjustment member about the pin 82 to provide a second degree of adjustment orthogonal to the degree of adjustment provided by the first adjustment member.

The latching of the antenna unit to the second adjusting member may be accomplished in several ways. However, it is highly desirable that the antenna be quickly and easily replaced in both an individual node mount or as an element in a hub array. The quick disconnect latch shown in FIGS. 3 and 4 is illustrated more clearly in FIGS. 6–8 and the operation thereof is schematically illustrated in FIG. 9.

Figure 6:
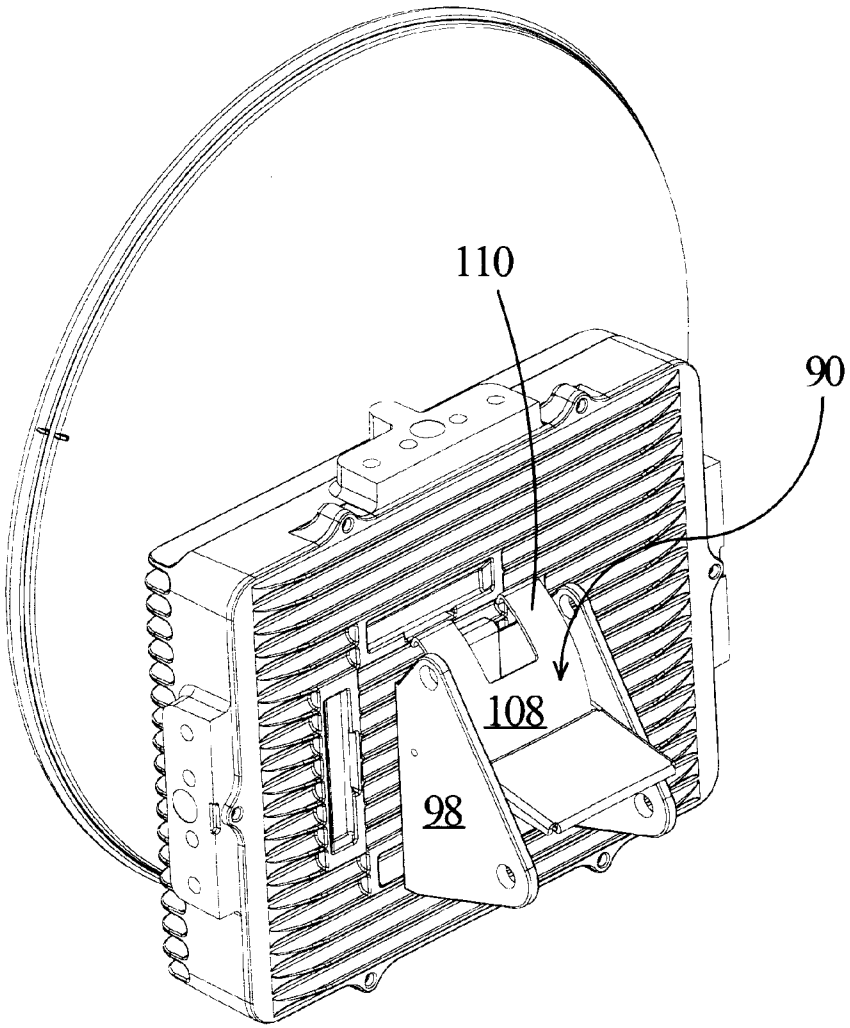
FIG. 6 is a pictorial view of one embodiment of the quick connect/disconnect latch mechanism of the present invention in the open position.
Figure 7:
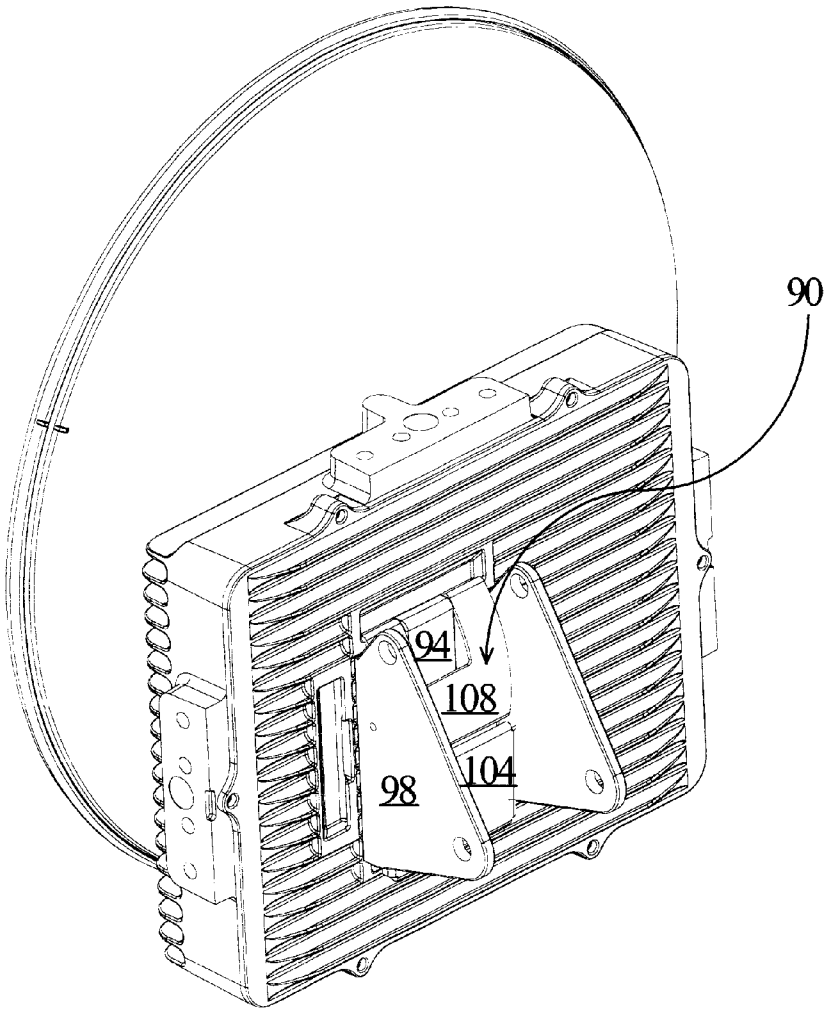
FIG. 7 is a pictorial view of the embodiment of the quick connect/disconnect latch mechanism illustrated in FIG. 6 in the latched or closed position.
Figure 8:
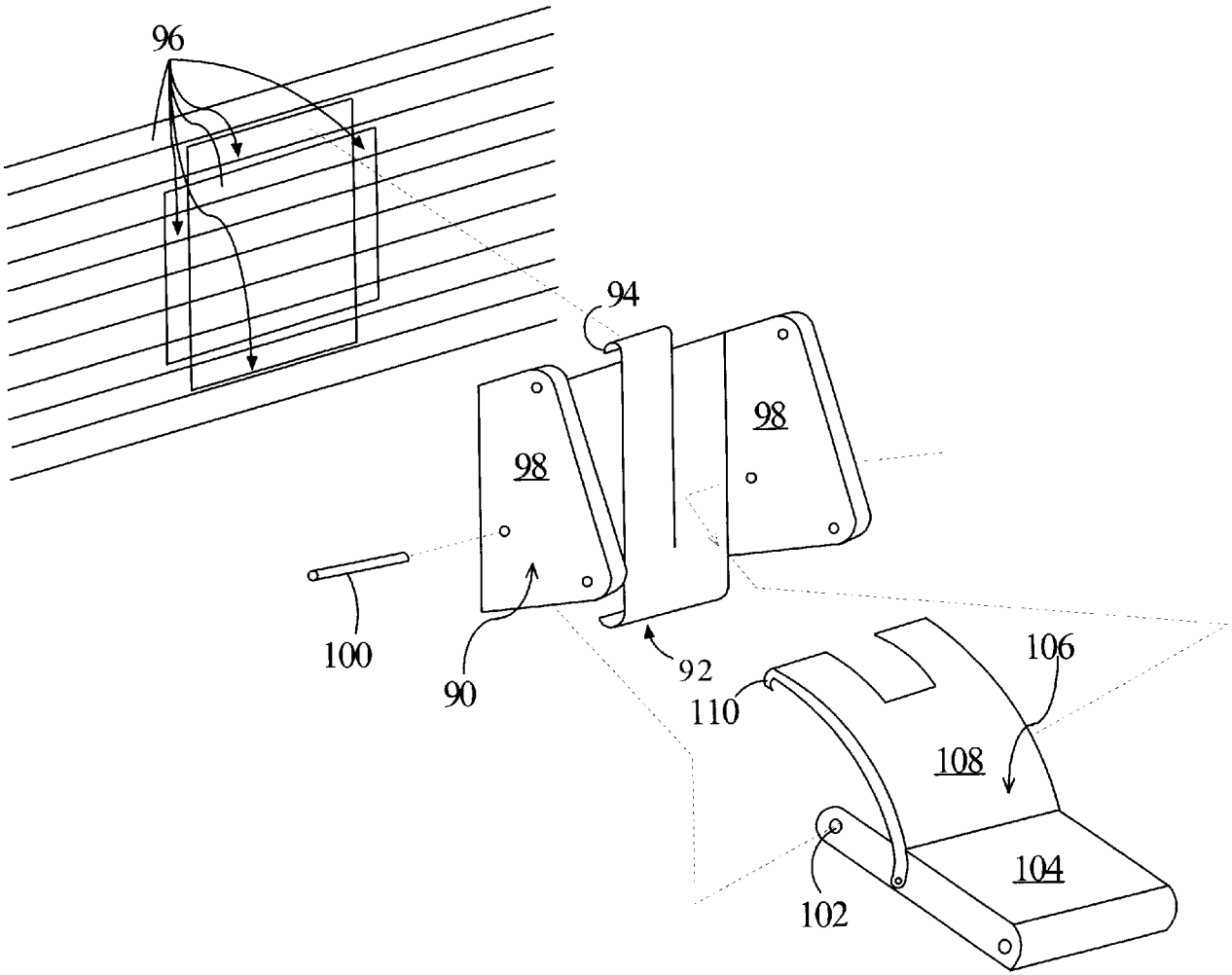
FIG. 8 is a schematic exploded illustration of the embodiment of the latch illustrated in FIGS. 6 and 7.
Figure 9:
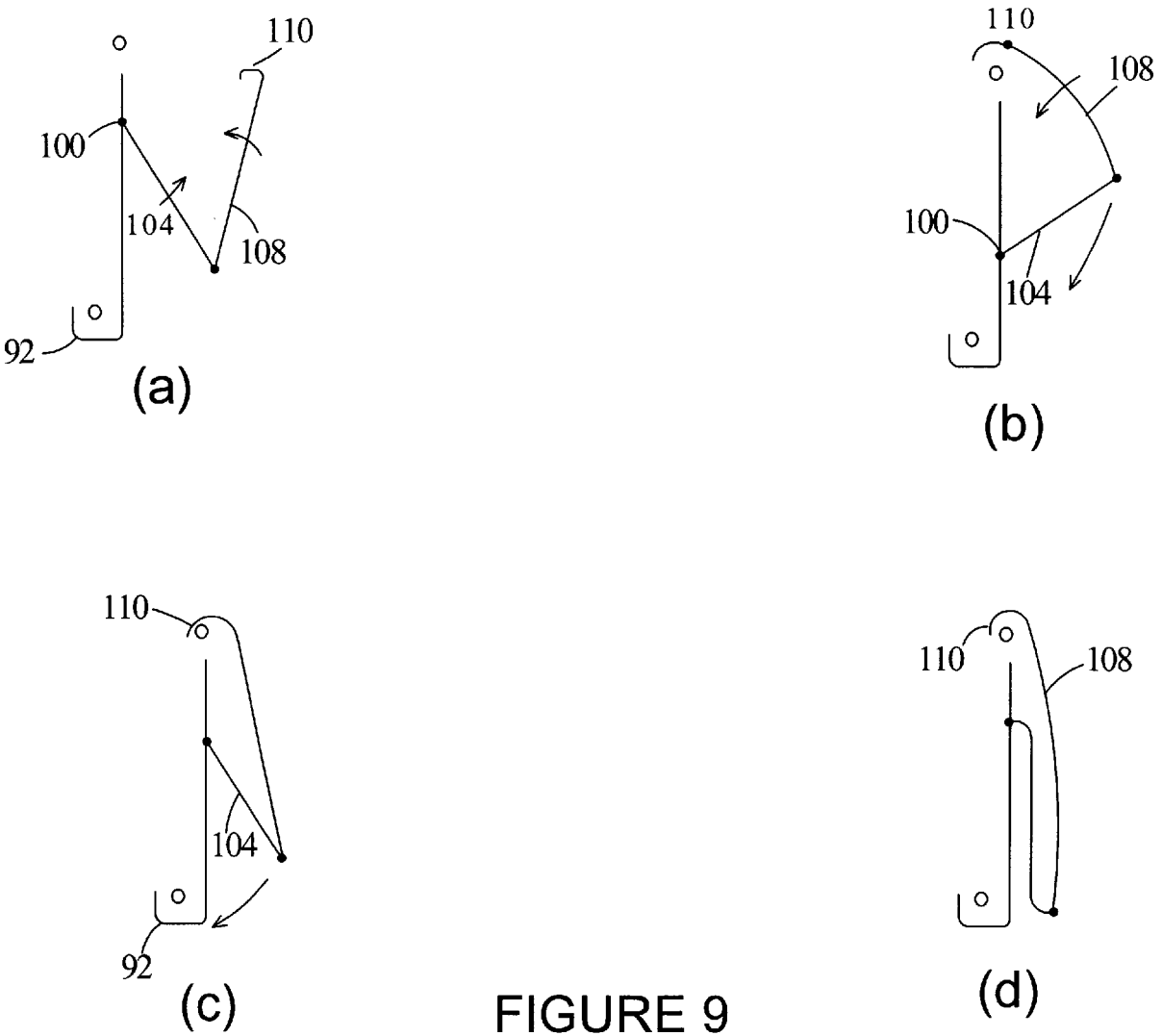
FIGS. 9(*a*) through 9(*d*) are schematic illustrations of the operation of the embodiment of the quick connect/disconnect latch mechanism of FIGS. 6–8.

With reference to FIGS. 6–8, the latch generally includes a first member 90 adapted to be carried by the second adjustment member of the mounts of FIGS. 3–5. The first member 90 includes a first forward facing hook or first male member 92 at the lower edge of the center section adapted to engage an element on the antenna. The center section of the first member also desirably carries a spring biased element 94 adapted to engage one of the slots or female connectors 96 in the antenna to provide stability of the antenna during the latching operation.

The flanges 98 of the first member 90 may be provided with apertures to receive a pin 100 which passes through a hole 102 adjacent one end of the flat member 104 of a second member 106 so that the flat member may pivot about the pin 100. Approximately midway along the flat member 104 is hinged a curved member 108 which has at the distal end thereof a second hook or second male member 110 adapted to engage an element of the antenna.

Alternatively, suitable protrusions from the sides of the flat member 104 may engage a detent on the curved member 108 to provide the pivotal connection.

In operation, and as shown in FIG. 9(*a*), the first member is placed against the antenna with the lower hook or first male member 92 engaged and both the flat member 104 and the curved member 108 out of contact with the antenna. As shown in FIG. 9(*a*), both the flat and curved members may then be rotated counterclockwise to position the hook or second male member 110 in position to engage the antenna as shown in FIG. 9(*b*). Once the hook 110 is engaged, the flat member 104 may be rotated clockwise as shown in FIG. 9(*c*) into the latched position shown in FIG. 9(*d*) and in FIG. 7.

As shown in various of the figures, the antenna is desirably provide with latch receiving means on the back, ends and sides so that the antenna may be selectively latched to the mounting member in the orientation dictated by the antenna element itself.

It should be understood that the foregoing description of preferred embodiments is illustrative only and that various changes, substitutions and alterations can be made herein without departing from the spirit and scope of the invention as defined by the appended claims.

What is claimed is:

1. A latch to connect an antenna to a support bracket in a point-to-multipoint millimeter wave communication system, comprising:

a first member, configured to attach to a support bracket, said first member having a first hook forwardly extending therefrom, with the first hook configured to engage an antenna at a first point, and said first member having a guide member extending forward therefrom, with said guide member configured to engage the antenna at a second point spaced apart from the first point, to thereby maintain the orientation of the antenna relative to said bracket when connected thereto;

a second member, said second member having a second hook pivotably carried by and forwardly extending therefrom, with the second hook configured to engage an antenna at a third point spaced from the first and second points, said second member being pivotably carried by said first member for selectively positioning between:

(a) a first unlatched position, where the spacing between said hooks is at least as great as the spacing between the first and third points on the antenna so that said first hook engages the antenna at the first point without engagement of the antenna by the second hook, and (b) a second latch position where the spacing between said hooks is less than the spacing between the first and third points on the antenna so that the second hook engages the antenna at the third point while said first hook is in engagement with the antenna at the first point to thereby grasp the antenna at the first and second points; and means for releasably retaining said second member in said latched position.

2. A latch to connect an antenna to a support bracket in a communication system, comprising:

a first member, configured to attach to a support bracket, said first member having a first hook forwardly extending therefrom, with the first hook being configured to engage an antenna at a first point, and a second member having a second hook forwardly extending therefrom, with the second hook being configured to engage an antenna at a second point spaced from the first point, said second member being pivotably carried by said first member for selectively positioning between:

(a) a first unlatched position, where the spacing between said hooks is at least as great as the spacing between the first and second points on the antenna so that said first hook engages the antenna at the first point without engagement of the antenna by the second hook, and (b) a second latched position where the spacing between said hooks is less than the spacing between the first and second points on the antenna so that the second hook engages the antenna at the second point while said first hook is in engagement with the antenna at the first point to thereby grasp the antenna at the first and second points; and means for releasably retaining said second member in said latched position.

3. The latch of claim 2, where the second hook forwardly extending from the second member is pivotably carried by the second member.

4. The latch of claim 3, where the first member has extending forward therefrom a guide member configured to engage the antenna when attached to said bracket with said latch in the latched position to thereby maintain the orientation of the antenna relative to said bracket.

5. The latch of claim 4, where the antenna attached to the support bracket is configured for use in a point-to-multipoint millimeter wave communication system.

6. A method of latching an antenna in a communications system to a support bracket, allowing for quick connection and disconnection between the antenna and the support bracket, comprising the steps of:

(a) providing an antenna support bracket (b) providing a first member of a latch, said first member configured to connect to the support bracket, said first member configured with a forward extending hook for engaging the antenna at a certain point;

(c) providing a second member of the latch, pivotably connected to the first member with a forward extending hook for engaging, when the second member is pivoted to a first position, the antenna at a point separate from the point engaged by the hook of the first member, and for latching the antenna when the second member is pivoted to second position;

(d) connecting the first member of the latch to the support bracket;

(e) placing the antenna and the first member of the latch in such relative position that the forward-extending hook from the first member of the latch engages the antenna;

(f) pivoting the second member of the latch into the first position, such that the forward-extending hook of the second member engages the antenna; and (g) pivoting the second member of the latch in to the second position, the thereby latch the antenna.

7. A method of latching an antenna to a support bracket, allowing for quick connection and disconnection between the antenna and support bracket, comprising the steps of:

(a) providing an antenna support bracket having first and second latch members, the first latch member having a first male member and the second latch member having a second male member;

(b) providing an antenna having spaced apart female connectors;

(c) engaging one of the female connectors with said first male member without engaging the other of the female connectors with said second male member;

(d) pivoting the first of the latch members towards said second female connector without engaging the other of the female connectors with said second male member;

(e) pivoting the second latch member relative to the first latch member to thereby engage the other female connector with the second male member; and (f) pivoting the first latch member away from the other female member while maintaining the second male member in engagement with the other female member to thereby releasably latch the male members to the female connectors and the bracket to the antenna.

8. A method of latching an antenna to a support bracket, allowing for quick connection and disconnection between the antenna and the support bracket, comprising the steps of:

(a) providing an antenna with two spaced apart female connectors and an antenna support bracket with a first male member and a second male member articulatable at two points;

(b) engaging one of the female connectors with the first male member;

(c) articulating the second male member into a position to engage the other of the female connectors upon reducing the distance between the first and second male members; and (d) articulating the second male member to shorten the distance between the two male members to thereby grasp the two female connectors and releasably latch the antenna to the antenna bracket.

* * * * *